US008726987B2

(12) United States Patent
Kumar et al.

(10) Patent No.: US 8,726,987 B2
(45) Date of Patent: May 20, 2014

(54) FORMATION SENSING AND EVALUATION DRILL

(75) Inventors: Sunil Kumar, Celle (DE); Hendrik John, Celle (DE)

(73) Assignee: Baker Hughes Incorporated, Houston, TX (US)

( * ) Notice: Subject to any disclaimer, the term of this patent is extended or adjusted under 35 U.S.C. 154(b) by 304 days.

(21) Appl. No.: 13/246,622

(22) Filed: Sep. 27, 2011

(65) Prior Publication Data

US 2012/0080229 A1 Apr. 5, 2012

Related U.S. Application Data

(60) Provisional application No. 61/389,978, filed on Oct. 5, 2010.

(51) Int. Cl.
*E21B 49/08* (2006.01)

(52) U.S. Cl.
USPC ..... 166/264; 175/59

(58) Field of Classification Search
USPC ..... 175/21, 59; 166/100, 264
See application file for complete search history.

(56) References Cited

U.S. PATENT DOCUMENTS 5,687,806 A 11/1997 Sallwasser et al.
7,111,685 B2 * 9/2006 Fields ..... 166/298
8,210,284 B2 * 7/2012 Buchanan et al. ..... 175/78
2005/0279499 A1 * 12/2005 Tarvin et al. ..... 166/264
2007/0205021 A1 * 9/2007 Pelletier et al. ..... 175/59
2008/0121394 A1 5/2008 Tarvin et al.
2009/0120637 A1 5/2009 Kirkwood et al.
2009/0133871 A1 * 5/2009 Skinner et al. ..... 166/250.16
2010/0078170 A1 * 4/2010 Moody et al. ..... 166/285
2010/0224360 A1 9/2010 MacDougall et al.
2012/0074110 A1 * 3/2012 Zediker et al. ..... 219/121.72

OTHER PUBLICATIONS

International Search Report for International Application No. PCT/US2011/053622; all references are cited above.

* cited by examiner

*Primary Examiner* — William P Neuder
(74) *Attorney, Agent, or Firm* — Cantor Colburn LLP

(57) ABSTRACT

The present disclosure relates methods and apparatuses for testing and sampling of underground formations or reservoirs. The apparatus may include at least one extendable element configured to penetrate a formation. The at least one extendable element may include at least one drill bit with a nozzle configured to receive formation fluids. The at least one extendable element may include at least one sensor disposed on the at least one extendable element. The at least one extendable element may also include a source of stimulus for stimulating the formation. The at least one extendable element may be configured to detach and/or attach from/to a bottom hole assembly (BHA). One method may include steps for performing testing on the formation for estimating a parameter of interest of the formation. Another method may include steps for performing testing to estimate a parameter of interest of the formation fluid.

22 Claims, 7 Drawing Sheets

FORMATION SENSING AND EVALUATION DRILL

CROSS-REFERENCES TO RELATED APPLICATIONS

This application claims priority from U.S. Provisional Patent Application Ser. No. 61/389,978, filed on Oct. 5, 2010, incorporated herein by reference in its entirety.

FIELD OF THE DISCLOSURE

This disclosure generally relates to testing and sampling of earth formations or reservoirs. More specifically, this disclosure relates to evaluating a parameter of interest of an earth formation in-situ during drilling operations, and, in particular, performing the evaluation using an extendable element configured to evaluate the parameter of interest.

BACKGROUND OF THE DISCLOSURE

To obtain hydrocarbons such as oil and gas, boreholes are drilled by rotating a drill bit attached at a drill string end. A large proportion of the current drilling activity involves directional drilling, i.e., drilling deviated and horizontal boreholes to increase the hydrocarbon production and/or to withdraw additional hydrocarbons from the earth's formations. Modern directional drilling systems generally employ a drill string having a bottom hole assembly (BHA) and a drill bit at an end thereof that is rotated by a drill motor (mud motor) and/or by rotating the drill string. A number of downhole devices placed in close proximity to the drill bit measure certain downhole operating parameters associated with the drill string. Such devices typically include sensors for measuring downhole temperature and pressure, azimuth and inclination measuring devices and a resistivity-measuring device to determine the presence of hydrocarbons and water. Additional down-hole instruments, known as logging-while-drilling (LWD) tools, are frequently attached to the drill string to determine the formation geology and formation fluid conditions during the drilling operations.

Boreholes are usually drilled along predetermined paths and the drilling of a typical borehole proceeds through various formations. The drilling operator typically controls the surface-controlled drilling parameters, such as the weight on bit, drilling fluid flow through the drill pipe, the drill string rotational speed and the density and viscosity of the drilling fluid to optimize the drilling operations. The downhole operating conditions continually change and the operator must react to such changes and adjust the surface-controlled parameters to optimize the drilling operations. For drilling a borehole in a virgin region, the operator typically has seismic survey plots which provide a macro picture of the subsurface formations and a pre-planned borehole path. For drilling multiple boreholes in the same formation, the operator also has information about the previously drilled boreholes in the same formation.

Hydrocarbon zones may be tested during or after drilling. One type of test involves producing fluid from the formation and collecting samples with a probe or dual packers, reducing pressure in a test volume and allowing the pressure to build-up to a static level. This sequence may be repeated several times at several different depths or point within a single borehole. Testing may include exposing the formation or a sample from the formation to stimuli, such as acoustic energy or electromagnetic energy. From these tests, information can be derived for estimating parameters of interest regarding the formation.

Samples brought up through the borehole may become contaminated by other material in the borehole, including drilling fluid. This risk of contamination limits the value of surface analysis of the samples. Additionally, some parameters of a formation may only be estimated at the depth and under the conditions where drilling is taking place. The properties of a deeper regions of the formation (outside a mud-invaded zone) may be different from those regions in close proximity to the borehole due to the ingress of drilling fluid, which may mix with or displace native formation fluid. This contamination may result in erroneous measurements of properties of the deeper regions of the formation. There is a need for methods and apparatus for evaluating parameters of interest of a formation during the drilling process. The present disclosure discusses methods and apparatuses that satisfy this need.

SUMMARY OF THE DISCLOSURE

In aspects, the present disclosure generally relates to the testing and sampling of underground formations or reservoirs. More specifically, this disclosure relates to evaluating a parameter of interest of an earth formation in-situ during drilling operations, and, in particular, performing the evaluation using an extendable element configured to evaluate the parameter of interest.

One embodiment according to the present disclosure includes an apparatus for evaluating a parameter of interest of an earth formation, comprising: a bottom hole assembly (BHA) having a longitudinal axis; and at least one extendable element disposed on the BHA, the at least one extendable element including a drill bit with a nozzle configured to receive a formation fluid, the drill bit being configured to penetrate the earth formation in a direction inclined to the longitudinal axis.

Another embodiment according to the present disclosure includes a method of evaluating a parameter of interest of an earth formation, comprising: conveying a bottom hole assembly (BHA) having a longitudinal axis into a borehole; using at least one drill bit on at least one extendable element on the BHA for penetrating the earth formation to form a channel in a direction inclined to the longitudinal axis, wherein the earth formation is penetrated beyond a contaminated zone; and evaluating the parameter of interest.

Examples of the more important features of the disclosure have been summarized rather broadly in order that the detailed description thereof that follows may be better understood and in order that the contributions they represent to the art may be appreciated.

BRIEF DESCRIPTION OF THE DRAWINGS

For a detailed understanding of the present disclosure, reference should be made to the following detailed description of the embodiments, taken in conjunction with the accompanying drawings, in which like elements have been given like numerals, wherein.

DETAILED DESCRIPTION

Figure 1:
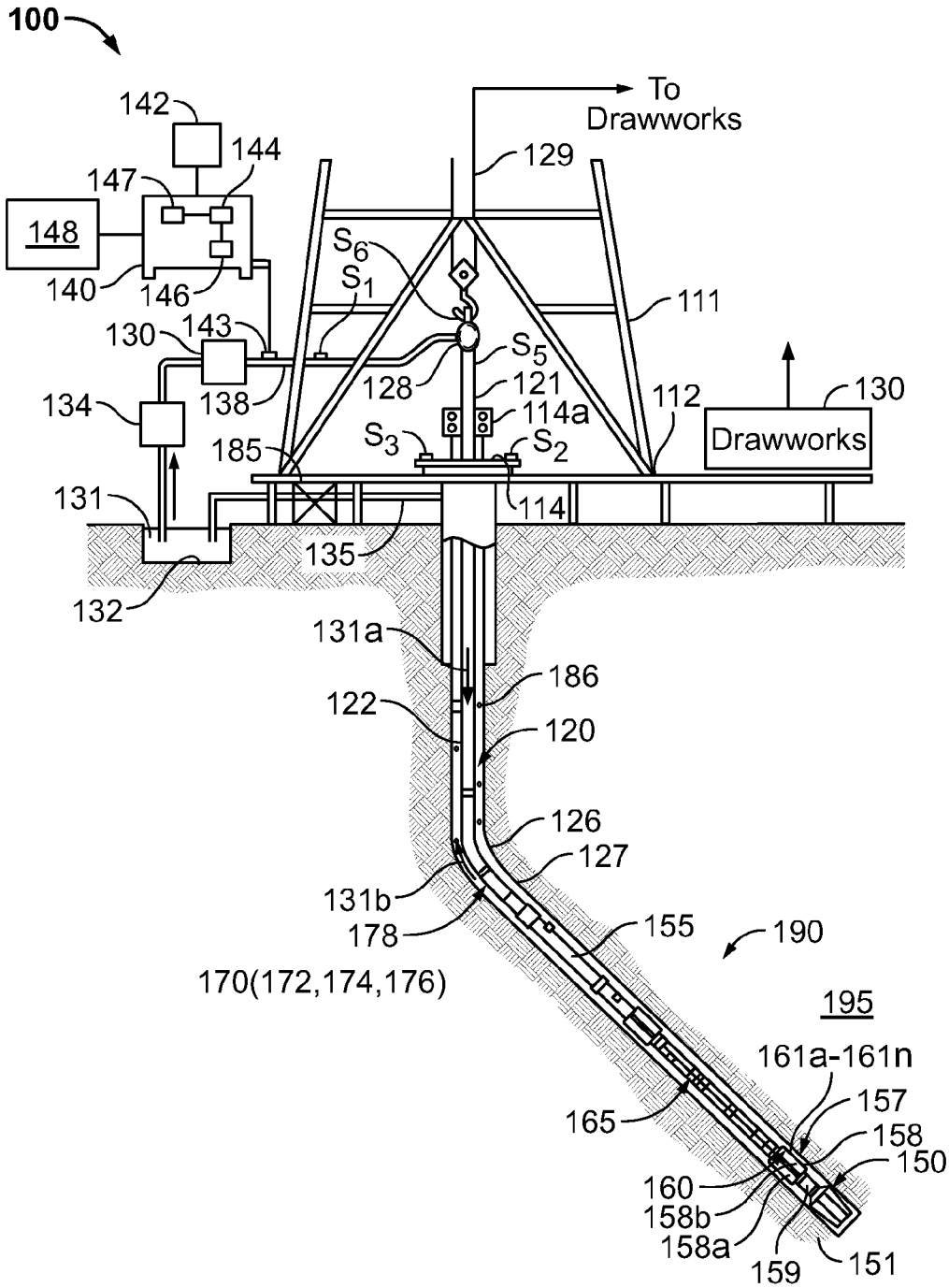
FIG. 1 shows a schematic of an exemplary drilling system according to one embodiment of the present disclosure.

This disclosure generally relates to the testing and sampling of underground formations or reservoirs. In one aspect, this disclosure relates to evaluating a parameter of interest of an earth formation in-situ during drilling operations, and, in another aspect, to evaluating a parameter of interest of an earth formation or a formation fluid using an extendable element configured to evaluate the parameter of interest. The parameter of interest may include, but is not limited to, one or more of: (i) pH of the formation fluid or wellbore drilling fluid, (ii) $H_2S$ concentration, (iii) density, (iv) viscosity, (v) temperature, (vi) rheological properties, (vii) thermal conductivity, (viii) electrical resistivity, (ix) chemical composition, (x) reactivity, (xi) radiofrequency properties, (xii) surface tension, (xiii) infra-red absorption, (xiv) ultraviolet absorption, (xv) refractive index, (xvi) magnetic properties, (xvii) nuclear spin, (xviii) permeability, (xix) porosity, (xx) nuclear-resonance properties, and (xxi) acoustic properties. Fluid in the formation may be contaminated by contact with drilling fluid and other materials located near the borehole wall, either inside or outside the borehole. The extendable element may include a drill bit for penetrating the formation so that a nozzle or probe may contact formation fluid or an area of the formation that has not been contaminated. The drill bit may also include one or more sensors for estimating a parameter of interest of the formation. The one or more sensors may be configured to estimate, but are not limited to, one or more of: (i) electromagnetic radiation, (ii) electric current, (iii) electrostatic potential, (iv) magnetic flux, (v) acoustic wave propagation, (vi) nuclear radiation, (vii) nuclear-resonance properties, (viii) electrical impedance, and (xix) mechanical force. The drill bit may also include a stimulus source configured to generate a response from the formation. The source may be configured to generate, but is not limited to, (i) electromagnetic radiation, (ii) electric current, (iii) voltage, (iv) magnetic fields, (v) acoustic waves, (vi) nuclear radiation, and (vii) mechanical force. The drill bit and extendable element may be configured to create a channel in the formation. The channel may be inclined relative to a longitudinal axis of the bottom hole assembly. In some embodiments, extendable element may include one or more packers or seals to isolate the portion of the formation with unadulterated formation fluid from sections of the formation that are contaminated or from drilling fluid in the borehole. In some embodiments, the fluid in the channel may be replaced with another fluid. The another fluid may be used to perform one or more of: (i) cleaning the channel, (ii) improving coupling for measurement source and/or receiver devices, and (iii) modifying the channel or formation chemically or physically. The nozzle of the drill bit may be connected to a conduit that runs through the extendable element and configured to receive and preserve the purity of the formation fluid as the formation fluid is moved from the formation into a bottom hole assembly. Within the bottom hole assembly, or drilling assembly, the formation fluid may be stored and/or analyzed by additional sensors or test equipment. In some embodiments, the formation fluid may be transported through the conduit using a pump or pressure differential.

The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein. Indeed, as will become apparent, the teachings of the present disclosure can be utilized for a variety of well tools and in all phases of well construction and production. Accordingly, the embodiments discussed below are merely illustrative of the applications of the present disclosure.

FIG. 1 is a schematic diagram of an exemplary drilling system 100 that includes a drill string having a drilling assembly attached to its bottom end that includes a steering unit according to one embodiment of the disclosure. FIG. 1 shows a drill string 120 that includes a drilling assembly or bottom-hole assembly (BHA) 190 conveyed by a carrier 122 in a borehole 126. The drilling system 100 includes a conventional derrick 111 erected on a platform or floor 112 which supports a rotary table 114 that is rotated by a prime mover, such as an electric motor (not shown), at a desired rotational speed. The carrier 122, such as jointed drill pipe, having the drilling assembly 190, attached at its bottom end extends from the surface to the bottom 151 of the borehole 126. A drill bit 150, attached to drilling assembly 190, disintegrates the geological formations when it is rotated to drill the borehole 126. The drill string 120 is coupled to a drawworks 130 via a Kelly joint 121, swivel 128 and line 129 through a pulley. Drawworks 130 is operated to control the weight on bit ("WOB"). The drill string 120 may be rotated by a top drive (not shown) instead of by the prime mover and the rotary table 114. Alternatively, a coiled-tubing may be used as the carrier 122. A tubing injector 114*a* may be used to convey the coiled-tubing having the drilling assembly attached to its bottom end. The operations of the drawworks 130 and the tubing injector 114*a* are known in the art and are thus not described in detail herein.

A suitable drilling fluid 131 (also referred to as the "mud") from a source 132 thereof, such as a mud pit, is circulated under pressure through the drill string 120 by a mud pump 134. The drilling fluid 131 passes from the mud pump 134 into the drill string 120 via a desurger 136 and the fluid line 138. The drilling fluid 131*a* from the carrier 122 discharges at the borehole bottom 151 through openings in the drill bit 150. The returning drilling fluid 131*b* circulates uphole through the annular space 127 between the drill string 120 and the borehole 126 and returns to the mud pit 132 via a return line 135 and drill cutting screen 185 that removes the drill cuttings 186 from the returning drilling fluid 131*b*. A sensor $S_1$ in line 138 provides information about the fluid flow rate. A surface torque sensor $S_2$ and a sensor $S_3$ associated with the drill string 120 respectively provide information about the torque and the rotational speed of the drill string 120. Tubing injection speed is determined from the sensor $S_5$, while the sensor $S_6$ provides the hook load of the drill string 120.

In some applications, the drill bit 150 is rotated by only rotating the drill pipe 122. However, in many other applications, a downhole motor 155 (mud motor) disposed in the drilling assembly 190 also rotates the drill bit 150. The rate of penetration for a given BHA 190 largely depends on the WOB or the thrust force on the drill bit 150 and its rotational speed.

The mud motor 155 is coupled to the drill bit 150 via a drive shaft disposed in a bearing assembly 157. The mud motor 155 rotates the drill bit 150 when the drilling fluid 131 passes through the mud motor 155 under pressure. The bearing assembly 157, in one aspect, supports the radial and axial forces of the drill bit 150, the down-thrust of the mud motor 155 and the reactive upward loading from the applied weight-on-bit.

A surface control unit or controller 140 receives signals from the downhole sensors and devices via a sensor 143 placed in the fluid line 138 and signals from sensors $S_1$-$S_6$ and other sensors used in the system 100 and processes such signals according to programmed instructions provided to the surface control unit 140. The surface control unit 140 displays desired drilling parameters and other information on a display/monitor 142 that is utilized by an operator to control the drilling operations. The surface control unit 140 may be a computer-based unit that may include a processor 147 (such as a microprocessor), a storage device 144, such as a solid-state memory, tape or hard disc, and one or more computer programs 146 in the storage device 144 that are accessible to the processor 147 for executing instructions contained in such programs. The surface control unit 140 may further communicate with a remote control unit 148. The surface control unit 140 may process data relating to the drilling operations, data from the sensors and devices on the surface, data received from downhole, and may control one or more operations of the downhole and surface devices. The data may be transmitted in analog or digital form.

The BHA may also contain formation evaluation sensors or devices (also referred to as measurement-while-drilling ("MWD") or logging-while-drilling ("LWD") sensors) determining resistivity, density, porosity, permeability, acoustic properties, nuclear-magnetic resonance properties, formation pressures, properties or characteristics of the fluids downhole and other desired properties of the earth formation 195 surrounding the drilling assembly 190. Such sensors are generally known in the art and for convenience are generally denoted herein by numeral 165. The drilling assembly 190 may further include a variety of other sensors and devices 159 for determining one or more properties of the BHA (such as vibration, bending moment, acceleration, oscillations, whirl, stick-slip, etc.) and drilling operating parameters, such as weight-on-bit, fluid flow rate, pressure, temperature, rate of penetration, azimuth, tool face, drill bit rotation, etc.) For convenience, all such sensors are denoted by numeral 159. Device 159 may include an evaluation module 200.

The drilling assembly 190 includes a steering apparatus or tool 158 for steering the drill bit 150 along a desired drilling path. In one aspect, the steering apparatus may include a steering unit 160, having a number of force application members 161*a*-161*n*, wherein the steering unit is at least partially integrated into the drilling motor. In another embodiment the steering apparatus may include a steering unit 158 having a bent sub and a first steering device 158*a* to orient the bent sub in the wellbore and the second steering device 158*b* to maintain the bent sub along a selected drilling direction.

The MWD system may include sensors, circuitry and processing software and algorithms for providing information about desired dynamic drilling parameters relating to the BHA, drill string, the drill bit and downhole equipment such as a drilling motor, steering unit, thrusters, etc. Exemplary sensors include, but are not limited to, drill bit sensors, an RPM sensor, a weight on bit sensor, sensors for measuring mud motor parameters (e.g., mud motor stator temperature, differential pressure across a mud motor, and fluid flow rate through a mud motor), and sensors for measuring acceleration, vibration, whirl, radial displacement, stick-slip, torque, shock, vibration, strain, stress, bending moment, bit bounce, axial thrust, friction, backward rotation, BHA buckling and radial thrust. Sensors distributed along the drill string can measure physical quantities such as drill string acceleration and strain, internal pressures in the drill string bore, external pressure in the annulus, vibration, temperature, electrical and magnetic field intensities inside the drill string, bore of the drill string, etc. Suitable systems for making dynamic downhole measurements include COPILOT, a downhole measurement system, manufactured by BAKER HUGHES INCORPORATED. Suitable systems are also discussed in "Downhole Diagnosis of Drilling Dynamics Data Provides New Level Drilling Process Control to Driller", SPE 49206, by G. Heisig and J. D. Macpherson, 1998.

The MWD system 100 can include one or more downhole processors at a suitable location such as 178 on the BHA 190. The processor(s) can be a microprocessor that uses a computer program implemented on a suitable machine readable medium that enables the processor to perform the control and processing. The machine readable medium may include ROMs, EPROMs, EAROMs, EEPROMs, Flash Memories, RAMs, Hard Drives and/or Optical disks. Other equipment such as power and data buses, power supplies, and the like will be apparent to one skilled in the art. In one embodiment, the MWD system utilizes mud pulse telemetry to communicate data from a downhole location to the surface while drilling operations take place. The surface processor 147 can process the surface measured data, along with the data transmitted from the downhole processor, to evaluate formation lithology. While a drill string 120 is shown as a conveyance system for sensors 165, it should be understood that embodiments of the present disclosure may be used in connection with tools conveyed via rigid (e.g. jointed tubular or coiled tubing) as well as non-rigid (e.g. wireline, slickline, e-line, etc.) conveyance systems. A downhole assembly (not shown) may include a bottom hole assembly and/or sensors and equipment for implementation of embodiments of the present disclosure on either a drill string or a wireline.

Figure 2:
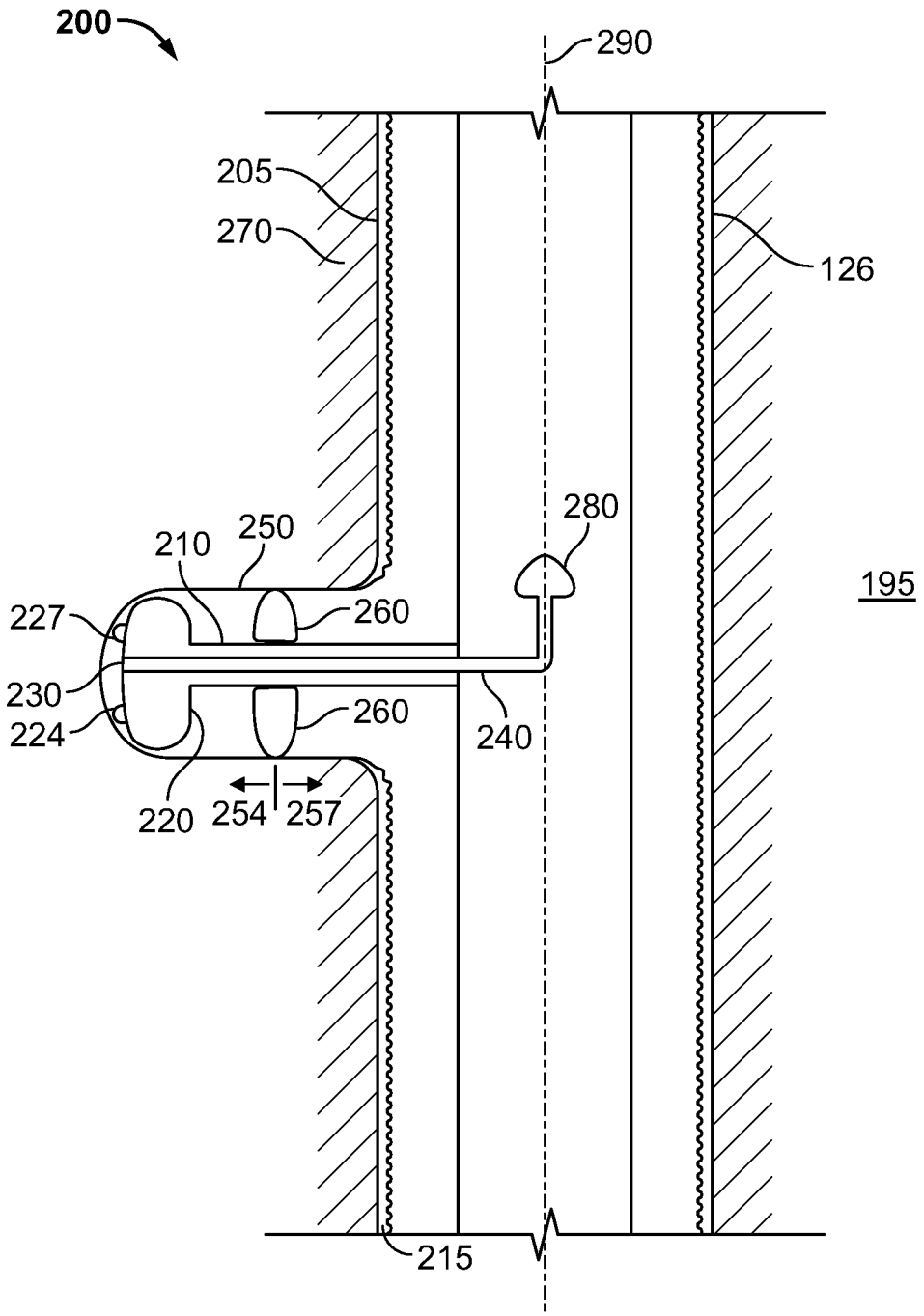
FIG. 2 shows a schematic of an exemplary evaluation module with an extendable element according to one embodiment of the present disclosure.

FIG. 2 shows an exemplary evaluation module 200 disposed on BHA 190 according to one embodiment of the present disclosure. Evaluation module 200 may include an extendable element 210 configured to penetrate formation 195. Extendable element 210 may include a drill bit 220. Drill bit 220 may include a nozzle 230 that may be joined to a conduit 240 that travels through the length of extendable element 210. Nozzle 230 may be fixed or retractable. In some embodiments, the nozzle 230 may be optional. The nozzle 230 and drill bit 220 may be configured to penetrate, the wall 205 of borehole 126, accumulated mud 215 on the wall 205, and formation 195. Drill bit 220 may create channel 250 when drilling through formation 195. The use of a drill bit to penetrate the formation is illustrative and exemplary only, as other formation disintegrating devices may be used, such as, but not limited to, ultrasonic transducers, lasers, high-pressure fluid drills, and gas jet drills. In some embodiments, channel 250 and extendable element 210 may be positioned substantially orthogonal to a longitudinal axis 290 of BHA 190. The orthgonality is not to be construed as a limitation and the drill bit may be inclined to the longitudinal axis of the BHA. Drill bit 220 may also include one or more sensors 224, wherein the one or more sensors may be configured to generate a signal in response to one or more of (i) electromagnetic radiation, (ii) electric current, (iii) electrostatic potential, (iv) magnetic flux, (v) acoustic wave propagation, (vi) nuclear radiation, (vii) nuclear-resonance properties, (viii) electrical impedance, and (ix) mechanical force. In some embodiments, the one or more sensors 224 may be positioned on the drill bit 220, along the extendable element 210, or on the BHA 190 within borehole 126. Drill bit 220 may also include one or more stimulus sources 227, wherein the one or more stimuli sources may be configured to generate one or more of (i) electromagnetic radiation, (ii) electric current, (iii) voltage, (iv) magnetic fields, (v) acoustic waves, (vi) nuclear radiation, and (vii) mechanical force. In some embodiments, the one or more stimulus sources 227 may be positioned on the drill bit 220, along the extendable element 210, or on the BHA 190 within borehole 126. One or more packers 260 may be disposed along extendable element 210 dividing side channel 250 into a formation side section 254 and a borehole side section 257. Seals or packers 260 may be configured to prevent the flow of fluid between section 254 and section 257, thus reducing the opportunity for formation fluid contamination. In some embodiments, packers 260 may be positioned outside of a mud-invaded or contaminated zone 270 of formation 195 to further reduce opportunity for contamination. Herein, the "contaminated zone" may refer to a section of the formation where the ingress of drilling fluid has mixed with or displaced the native formation fluid. In some embodiments, packers 260 may be retractable, inflatable, and/or extendable. Conduit 240 may be operably coupled to a chamber 280 within evaluation module 200 or bottom hole assembly 190. Chamber 280 may include test equipment, sensors, and/or storage equipment for evaluating, analyzing, and/or preserving a sample of formation fluid. Some embodiments may include a tank (not shown) for fluid that may be flowed through conduit 240 and nozzle 230 to clear debris from the channel 250. This fluid may be similar or different from drilling fluid.

In some embodiments, evaluation module 200 may include a communication unit (not shown) and power supply (not shown) for two-way communication to the surface and supplying power to the downhole components. In some embodiments, evaluation module 200 may include a downhole controller (not shown) configured to control the evaluation unit 200. Results of data processed downhole may be sent to the surface in order to provide downhole conditions to a drilling operator or to validate test results. The controller may pass processed data to a two-way data communication system disposed downhole. The communication system downhole may transmit a data signal to a surface communication system (not shown). There are several methods and apparatus known in the art suitable for transmitting data. Any suitable system would suffice for the purposes of this disclosure.

Figure 3:
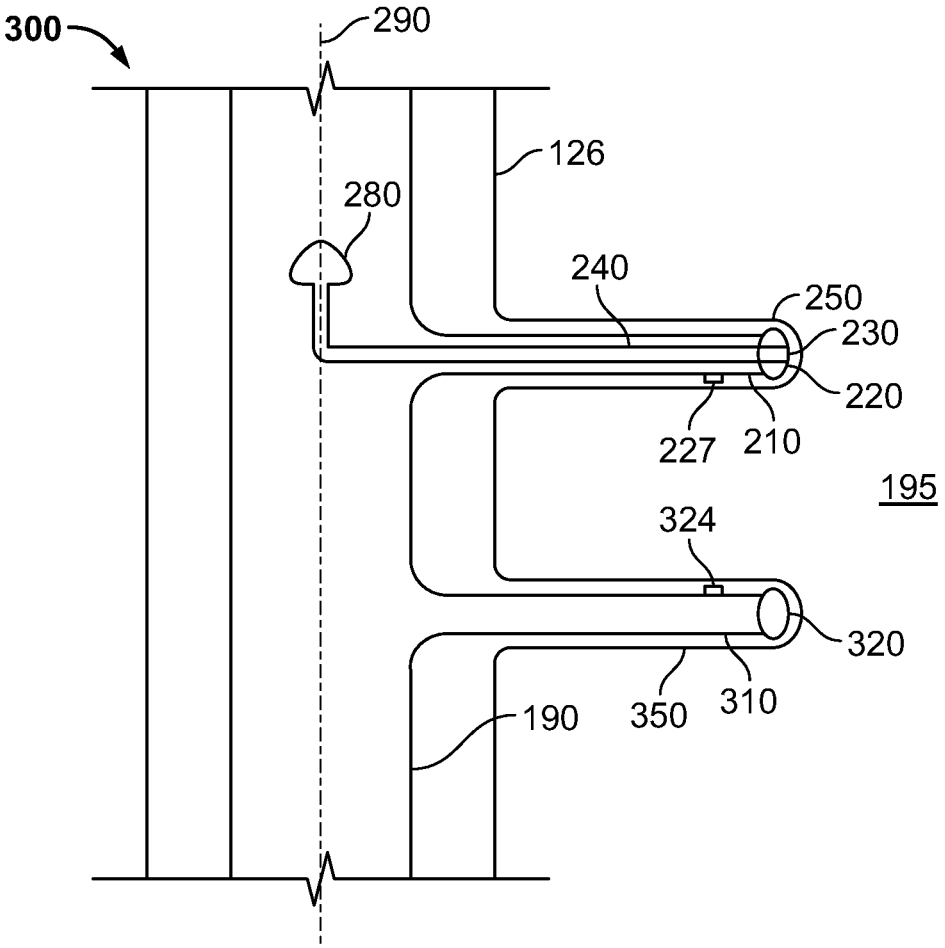
FIG. 3 shows a schematic of an exemplary evaluation module with two extendable elements according to one embodiment of the present disclosure.

FIG. 3 shows an exemplary evaluation module 300 disposed on BHA 190 according to another embodiment of the present disclosure. Evaluation module 300 may include at least two extendable elements 210, 310 disposed on the BHA 190 and inclined from the longitudinal axis 290. These positions may be at the same or different positions along the longitudinal axis 290 and/or at the same or different azimuthal angle. Each of the extendable elements 210, 310 may each have a drill bit 220, 320 for disintegrating formation 195 to form channels 250, 350. In some embodiments, one or more of the extendable elements may have a nozzle and conduit for receiving formation fluid. One or more stimulus sources 227 may be disposed along extendable element 210 and configured to exert at least one stimulus into the formation 195. One or more sensors 324 may be disposed along extendable element 310 and configured to receive a signal or energy from the formation 195, where the signal or energy may be responsive to a stimulus exerted on the formation 195 by one or more stimulus sources 227. In some embodiments, one or more of the extendable elements 210, 310 may be detachable and/or reattachable from BHA 190. In some embodiments, one or more of the extendable elements 210, 310 may have a locator device (not shown) such that the extendable elements 210, 310 that have been detached may be located for reattachment to the BHA 190. The locator device may be any common locator, including, but not limited to, one or more of: (i) a radio frequency tag, (ii) an acoustic locator, (iii) a radioactive tag, (iv) a mechanical latch, (v) a tether and (vi) a locator beacon. In some embodiments, one or more of the extendable elements 210, 310 may include a memory storage device (not shown) for recording information from the one or more sensors while the extendable element 210, 310 may be detached from the BHA 190.

Figure 4:
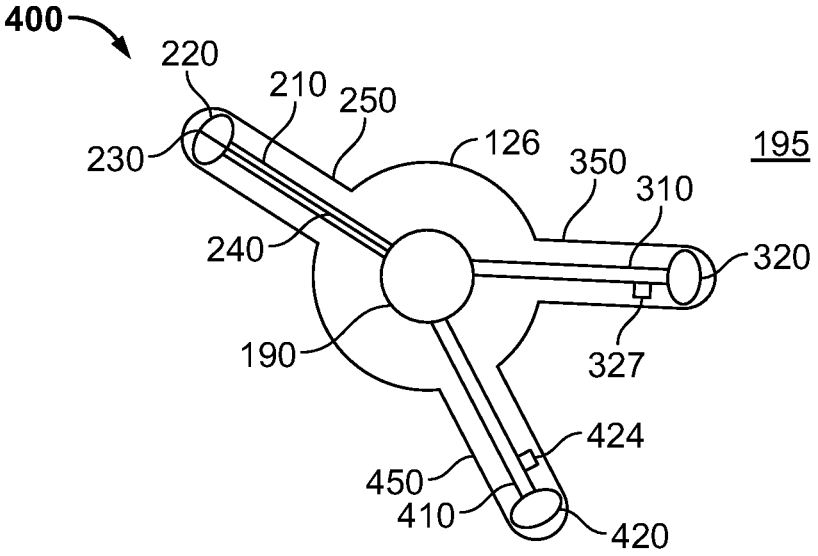
FIG. 4 shows a schematic of an exemplary evaluation module with three extendable elements deployed in different azimuthal directions according to one embodiment of the present disclosure.

FIG. 4 shows an exemplary evaluation module 400 disposed on BHA 190 according to another embodiment of the present disclosure. Evaluation module 400 may include two or more extendable elements 210, 310, 410, each with a drill bit 220, 320, 420, disposed within borehole 126. The extendable elements 210, 310, 410 may be extended into formation 195 to disintegrate part of the formation and form channels 250, 350, 450. In some embodiments, one or more stimulus sources 327 may be positioned along extendable element 310 and one or more sensors 424 may be positioned along extendable element 410. In some embodiments, the extendable elements 210, 310, 410 may be positioned in different azimuthal directions radiating from BHA 190. In some embodiments, more than three extendable elements may be used. In some embodiments, two or more extendable elements may be positioned in the same azimuthal direction but at different depths along the longitudinal axis 290 (FIG. 3).

Figure 5:
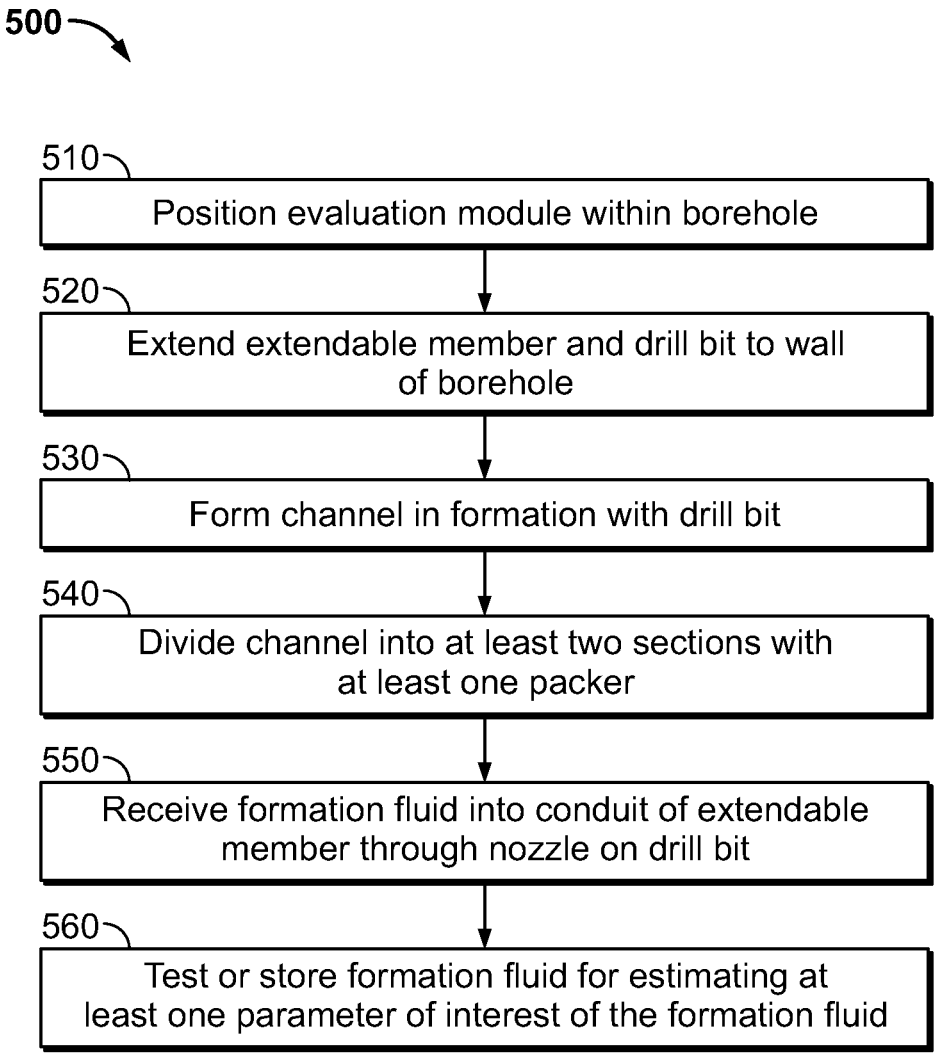
FIG. 5 shows a flow chart of a method for estimating a parameter of interest of a formation fluid in situ according to one embodiment of the present disclosure.

FIG. 5 shows a flow chart of some steps of an exemplary method 500 according to one embodiment (FIG. 2) of the present disclosure for testing and sampling a fluid from a formation or reservoir 195. In step 510, evaluation module 200 may be positioned within borehole 126. In step 520, extendable element 210 with drill bit 220 may be extended to the wall 205 of borehole 126. In some embodiments, the extendable element 210 may be extended in a direction that is inclined to the longitudinal axis 290 of the BHA 190. In step 530, drill bit 220 may disintegrate part of formation 195 to form a channel 250. During the disintegration of the formation 195, the drill bit may also disintegrate part of the wall 205 and debris or mud 215 accumulated on the wall 205. In step 540, one or more packers 260 may be inflated or expanded to divide channel 250 into a formation side section 254 and a borehole side section 257. The one or more packers 260 may also prevent fluid flow between section 254 and 257 within channel 250. In step 550, formation fluid may be received into conduit 240, which is within extendable element 210, through nozzle 230 on drill bit 220. In step 560, formation fluid may be transported through conduit 240 to chamber 280. In step 560, the formation fluid sample within chamber 280 may be tested or stored for later testing to estimate at least one parameter of interest of the formation fluid. The at least one parameter of interest of the formation fluid may include, but is not limited to, one of: (i) pH, (ii) $H_2S$ concentration, (iii) density, (iv) viscosity, (v) temperature, (vi) rheological properties, (vii) thermal conductivity, (viii) electrical resistivity, (ix) chemical composition, (x) reactivity, (xi) radiofrequency properties, (xii) surface tension, (xiii) infra-red absorption, (xiv) ultraviolet absorption, (xv) refractive index, (xvi) magnetic properties, (xvii) nuclear spin, (xviii) nuclear-resonance properties, and (xix) acoustic properties. In some embodiments, another fluid may be injected into the channel to replace fluid removed or to flush out the channel.

Figure 6:
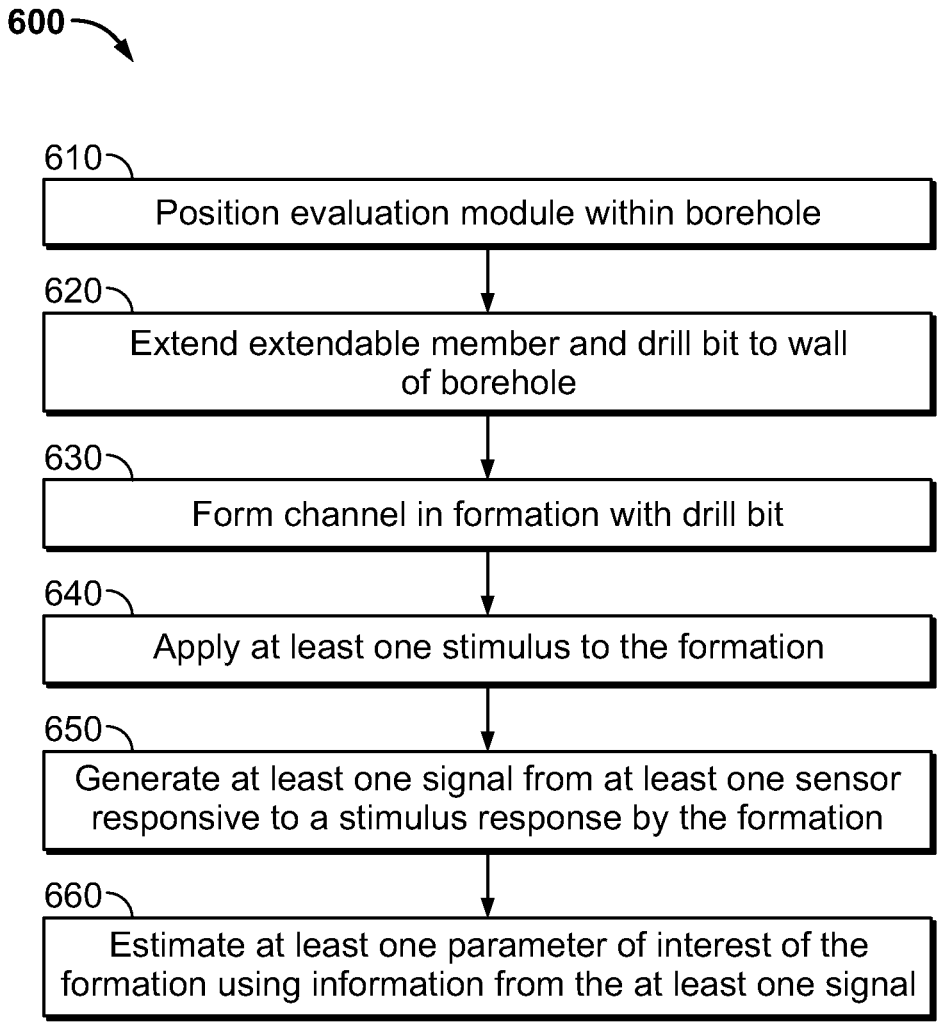
FIG. 6 shows a flow chart of a method for estimating a parameter of interest of a formation according to one embodiment of the present disclosure.

FIG. 6 shows a flow chart of an exemplary method 600 according to one embodiment (FIG. 2) of the present disclosure for testing and sampling a formation or reservoir 195. In step 610, evaluation module 200 may be positioned within borehole 126. In step 620, extendable element 210 with drill bit 220 may be extended to the wall 205 of borehole 126. In some embodiments, the extendable element 210 may be extended in a direction that is inclined to the longitudinal axis 290 of the BHA 190. In step 630, drill bit 220 may disintegrate part of formation 195 to form a channel 250. During the disintegration of the formation 195, the drill bit may also disintegrate part of the wall 205 and debris or mud 215 accumulated on the wall 205. In step 640, a stimulus may be applied to the formation 195. The stimulus may be applied by one or more stimulus sources 227 and may include, but is not limited to, one or more of: (i) electromagnetic radiation, (ii) electric current, (iii) voltage, (iv) magnetic fields, (v) acoustic waves, (vi) nuclear radiation, and (vii) mechanical force. In step 650, at least one signal may be generated by one or more sensors 224 in response to the formation's response to the one or more stimuli. The one or more sensors 224 may be configured to be responsive to, but not limited to, one or more of: (i) electromagnetic radiation, (ii) electric current, (iii) electrostatic potential, (iv) magnetic flux, (v) acoustic wave propagation, (vi) nuclear radiation, (vii) nuclear-resonance properties, (viii) electrical impedance, and (ix) mechanical force. In step 660, information from the at least one signal may be used by at least one processor to estimate at least one parameter of interest of the formation 195. The at least one parameter of interest of the formation 195 may include, but is not limited to, one of: (i) density, (ii) viscosity, (iii) temperature, (iv) thermal conductivity, (v) electrical resistivity, (vi) chemical composition, (vii) reactivity, (viii) radiofrequency properties, (ix) infra-red absorption, (x) ultraviolet absorption, (xi) magnetic properties, (xii) permeability, (xiii) porosity, (xiv) nuclear-resonance properties, and (xv) acoustic properties.

Figure 7:
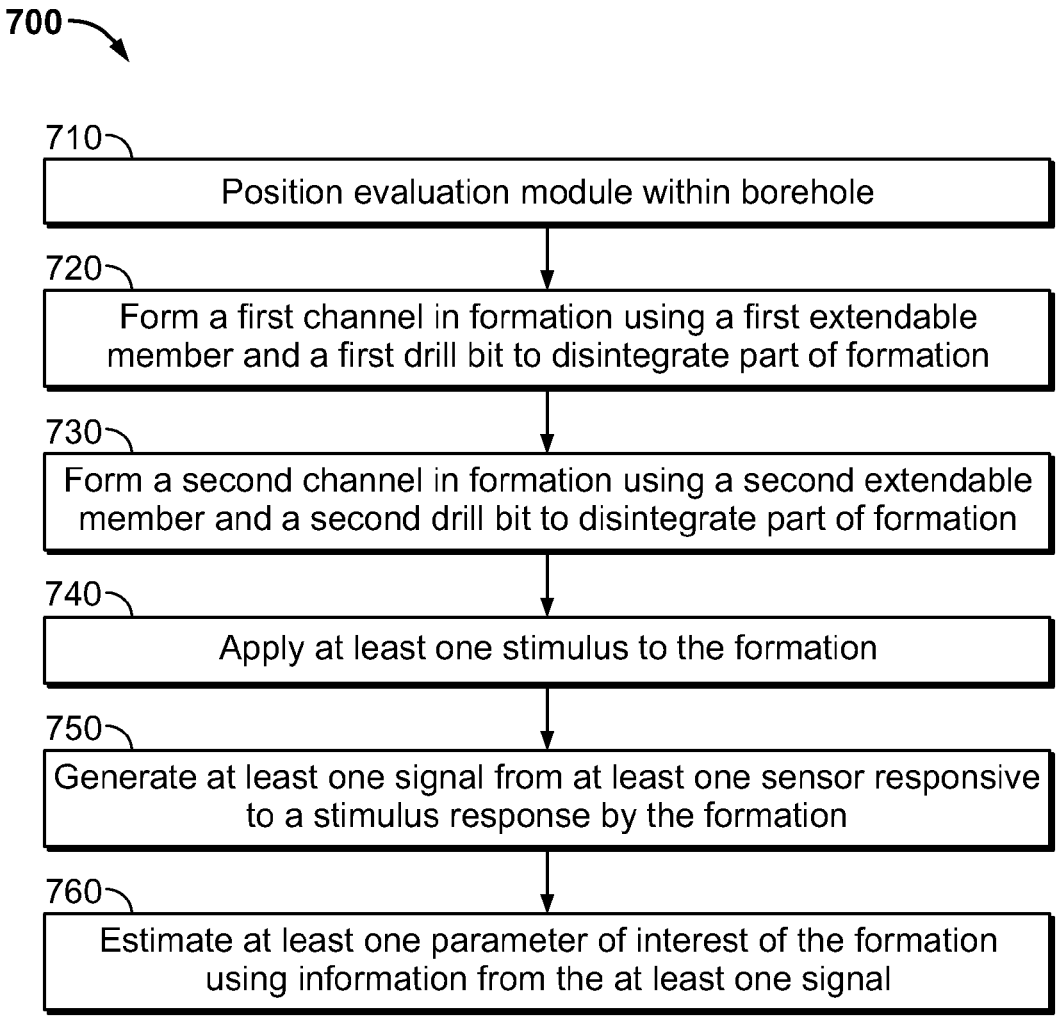
FIG. 7 shows a flow chart of a method for estimating a parameter of interest of a formation using two extendable elements according to one embodiment of the present disclosure.

FIG. 7 shows a flow chart of an exemplary method 700 according to one embodiment (FIG. 3) of the present disclosure for testing and sampling a formation or reservoir 195. In step 710, evaluation module 300 may be positioned within borehole 126. In step 720, extendable element 210 with drill bit 220 may be extended into formation 195 in a direction inclined relative to longitudinal axis 290, disintegrating part of the formation 195 to form channel 250. In step 730, extendable element 310 with drill bit 320 may be extended into formation 195 in a direction inclined relative to longitudinal axis 290, disintegrating another part of formation 195 to form channel 350. In some embodiments, channel 250 may be similar to channel 350 only above or below along longitudinal axis 290. In some embodiments, channel 250 may be at a different azimuth from channel 350. In step 740, a stimulus may be applied to formation 195 by one or more stimulus source 227. The stimulus may be applied by one or more stimulus sources 227 and may include, but is not limited to, one or more of: (i) electromagnetic radiation, (ii) electric current, (iii) voltage, (iv) magnetic fields, (v) acoustic waves, (vi) nuclear radiation, and (vii) mechanical force. In step 750, at least one signal may be generated by one or more sensors 324 in response to the formation's response to the one or more stimuli. The one or more sensors 324 may be configured to be responsive to, but not limited to, one or more of: (i) electromagnetic radiation, (ii) electric current, (iii) electrostatic potential, (iv) magnetic flux, (v) acoustic wave propagation, (vi) nuclear radiation, (vii) nuclear-resonance properties, (viii) electrical impedance, and (ix) mechanical force. In step 760, information from the at least one signal may be used by at least one processor to estimate at least one parameter of interest of the formation 195. The at least one parameter of interest of the formation 195 may include, but is not limited to, one of: (i) density, (ii) viscosity, (iii) temperature, (iv) thermal conductivity, (v) electrical resistivity, (vi) chemical composition, (vii) reactivity, (viii) radiofrequency properties, (ix) infra-red absorption, (x) ultraviolet absorption, (xi) magnetic properties, (xii) permeability, (xiii) porosity, (xiv) nuclear-resonance properties, and (xv) acoustic properties.

Figure 8:
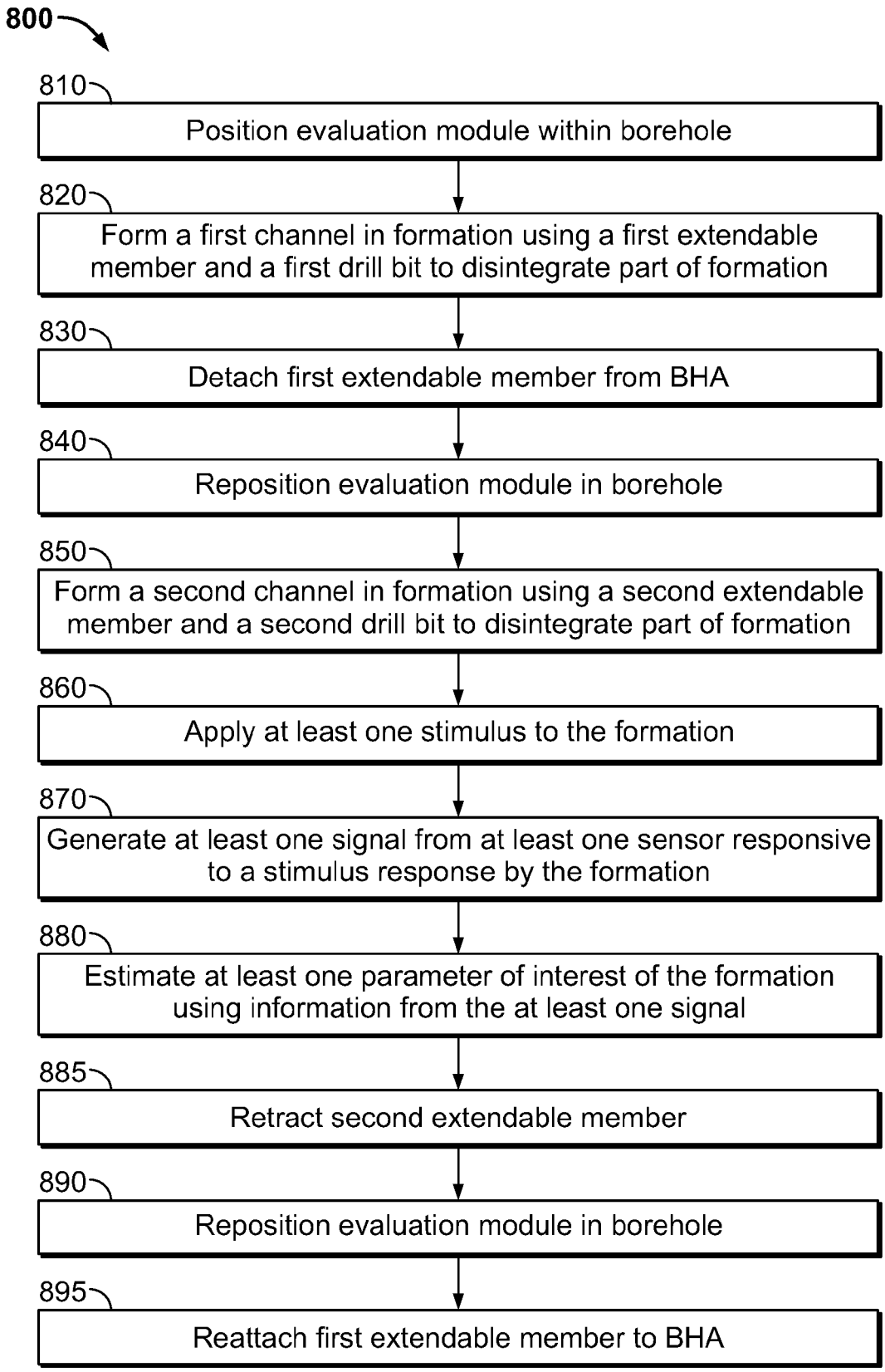
FIG. 8 shows a flow chart of a method for estimating a parameter of interest of a formation using at least one detachable extendable element according to one embodiment of the present disclosure.

FIG. 8 shows a flow chart of an exemplary method 800 according to one embodiment (FIG. 3) of the present disclosure for testing and sampling a formation or reservoir 195. In step 810, evaluation module 300 may be positioned within borehole 126. In step, 820, extendable element 210 with drill bit 220 may be extended into formation 195 in a direction inclined relative to longitudinal axis 290 forming channel 250. In step 830, extendable element 210 may be detached from BHA 190. In step 840, evaluation module 300 may be repositioned within the borehole 126. In step 850, extendable element 310 with drill bit 320 may be extended into formation 195 in a direction inclined relative to longitudinal axis 290 forming channel 350. In some embodiments, both extendable elements 210, 310 may be detached from the BHA 190. In some embodiments, channel 250 may be similar to channel 350 only above or below along longitudinal axis 290. In some embodiments, channel 250 may be at a different azimuth from channel 350. In step 860, a stimulus may be applied to formation 195 by one or more stimulus source 227. The stimulus may be applied by one or more stimulus sources 227 and may include, but is not limited to, one or more of: (i) electromagnetic radiation, (ii) electric current, (iii) voltage, (iv) magnetic fields, (v) acoustic waves, (vi) nuclear radiation, and (vii) mechanical force. In step 870, at least one signal may be generated by one or more sensors 324 in response to the formation's response to the one or more stimuli. The one or more sensors 324 may be configured to be responsive to, but not limited to, one or more of: (i) electromagnetic radiation, (ii) electric current, (iii) electrostatic potential, (iv) magnetic flux, (v) acoustic wave propagation, (vi) nuclear radiation, (vii) nuclear-resonance properties, (viii) electrical impedance, and (ix) mechanical force. In some embodiments, the at least one signal may be recorded on a memory storage device (not shown) coupled to or internal to the extendable element 310. In step 880, information from the at least one signal may be used by at least one processor to estimate at least one parameter of interest of the formation 195. The at least one parameter of interest of the formation 195 may include, but is not limited to, one of: (i) density, (ii) viscosity, (iii) temperature, (iv) thermal conductivity, (v) electrical resistivity, (vi) chemical composition, (vii) reactivity, (viii) radiofrequency properties, (ix) infra-red absorption, (x) ultraviolet absorption, (xi) magnetic properties, (xii) permeability, (xiii) porosity, (xiv) nuclear-resonance properties, and (xv) acoustic properties. In step 885, extendable element 310 may be retracted from channel 350. In some embodiments, the extendable elements 210, 310 may be used collapse or fill the channels 250, 350 when the extendable elements 210, 310 are retracted. In step 890, evaluation module 300 may be repositioned so that extendable element 210 may be reattached to BHA 190. In some embodiments, extendable element 210 may be located for reattachment using a locator device (not shown). The locator device may be any common locator, including, but not limited to, one or more of: (i) a radio frequency tag, (ii) an acoustic locator, (iii) a radioactive tag, (iv) a mechanical latch, (v) a tether, and (vi) a locator beacon. In some embodiments, one or more of the extendable elements may be configured for detachment but not reattachment. In step 895, extendable element 210 may be reattached to BHA 190. In some embodiments, some steps of methods 500, 600, 700, and 800 may be combined and/or performed simultaneously.

While the foregoing disclosure is directed to the one mode embodiments of the disclosure, various modifications will be apparent to those skilled in the art. It is intended that all variations be embraced by the foregoing disclosure.

We claim:

1. An apparatus for evaluating a parameter of interest of an earth formation, comprising:

a bottom hole assembly (BHA) having a longitudinal axis; and at least one extendable element disposed on the BHA, the at least one extendable element including a drill bit with a nozzle configured to receive a formation fluid and a sensing element disposed on the at least one extendable element, the drill bit being configured to penetrate the earth formation in a direction inclined to the longitudinal axis.

2. The apparatus of claim 1, the at least one extendable element further comprising:

at least one packer configured to isolate the nozzle from a borehole fluid.

3. The apparatus of claim 1, the at least one extendable element further comprising:

a stimulus source configured to transmit a stimulus into the earth formation.

4. The apparatus of claim 3, wherein the stimulus transmitted includes at least one of: (i) mechanical work, (ii) acoustic energy, (iii) electricity, (iv) magnetism, (v) nuclear radiation, and (vi) electromagnetic radiation.

5. The apparatus of claim 1, further comprising a conveyance device configured to convey the BHA into a borehole in the earth formation.

6. The apparatus of claim 1, wherein the at least one extendable element is configured to sense at least one of: (i) electromagnetic radiation, (ii) electric current, (iii) electrostatic potential, (iv) magnetic flux, (v) acoustic wave propagation, (vi) nuclear radiation, (vii) nuclear-resonance properties, (viii) electrical impedance, and (ix) mechanical force.

7. The apparatus of claim 1, wherein the at least one extendable element is configured for detachment from the BHA.

8. The apparatus of claim 7, wherein the at least one extendable element is configured for reattachment to the BHA.

9. The apparatus of claim 8, wherein the at least one extendable element comprises a locator device.

10. The apparatus of claim 1, further comprising:

a locator device disposed on the at least one extendable element.

11. The apparatus of claim 10, wherein the locator device may include at least one of: (i) a radio frequency tag, (ii) an acoustic locator, (iii) a radioactive tag, (iv) a mechanical latch, (v) a tether, and (vi) a locator beacon.

12. The apparatus of claim 1, further comprising:

at least one additional extendable element disposed on the BHA, the at least one additional extendable element including an additional drill bit, the additional drill bit being configured to penetrate the earth formation in a direction inclined to the longitudinal axis.

13. A method of evaluating a parameter of interest of an earth formation, comprising:

conveying a bottom hole assembly (BHA) having a longitudinal axis into a borehole;

using at least one drill bit on at least one extendable element on the BHA for penetrating the earth formation to form a channel in a direction inclined to the longitudinal axis, wherein the earth formation is penetrated beyond a contaminated zone; and evaluating the parameter of interest using a sensing element disposed on the at least one extendable element.

14. The method of claim 13, further comprising:

receiving a formation fluid using a nozzle on the at least one extendable element.

15. The method of claim 14, further comprising:

dividing the channel into at least two sections using at least one packer disposed on the at least one extendable element.

16. The method of claim 13, further comprising:

transmitting a stimulus into the formation outside the contaminated zone.

17. The method of claim 16, wherein the stimulus includes at least one of: (i) mechanical work, (ii) acoustic energy, (iii) electricity, (iv) magnetism, (v) nuclear radiation, and (vi) electromagnetic radiation.

18. The method of claim 16, wherein the at least one extendable element comprises a first extendable element and a second extendable element, and wherein the stimulus is transmitted using the first extendable element and sensed using the second extendable element.

19. The method of claim 13, wherein evaluating the parameter of interest includes sensing at least one of: (i) electromagnetic radiation, (ii) electric current, (iii) electrostatic potential, (iv) magnetic flux, (v) acoustic wave propagation, (vi) nuclear radiation, vii) nuclear-resonance properties, (viii) electrical impedance, and (ix) mechanical force.

20. The method of claim 13, further comprising:

detaching the at least one extendable element from the BHA.

21. The method of claim 20, further comprising reattaching the at least one extendable element to the BHA.

22. The method of claim 20, further comprising:

locating the at least one extendable element in the borehole.

* * * * *